United States Patent [19]

High

[11] 4,074,905

[45] Feb. 21, 1978

[54] BASEBALL BATTING CAGES

[76] Inventor: Thaine High, 1810 W. 23rd St., Lawrence, Kans. 66044

[21] Appl. No.: 705,410

[22] Filed: July 15, 1976

[51] Int. Cl.[2] ..... A63B 69/00

[52] U.S. Cl. ..... 273/26 D; 124/7; 273/26 A; 124/51 R

[58] Field of Search ..... 273/26 R, 26 A, 26 D, 273/29 R, 29 A, 201, 202, 35 B, 181 F, 3; 124/6, 4, 7, 41 R, 51 R, 36

[56] References Cited

U.S. PATENT DOCUMENTS

| | | | |
|---|---|---|---|
| 702,415 | 6/1902 | Edwards | 273/26 D |
| 1,552,849 | 9/1925 | Lantz | 273/26 D |
| 1,825,882 | 10/1931 | Mauney | 273/26 D X |

*Primary Examiner*—Richard C. Pinkham
*Assistant Examiner*—T. Brown
*Attorney, Agent, or Firm*—Thomas M. Scofield

[57] ABSTRACT

Improvements in baseball batting cages directed to providing a limited area, fully enclosed and fully automatic baseball batting cage utilizing a conventional baseball pitching machine; improvements in the floor configuration of a limited area baseball batting cage operative to gravity return all pitched balls, whether struck by the batter or not, to a ball pickup zone; an improved baseball pickup and return device cooperating with said floor construction making possible the automatic operation of the batting cage; improvements in the positioning and mounting of a pitching machine in a baseball batting cage which facilitates the batting cage being both minimum in area and fully automatic.

5 Claims, 10 Drawing Figures

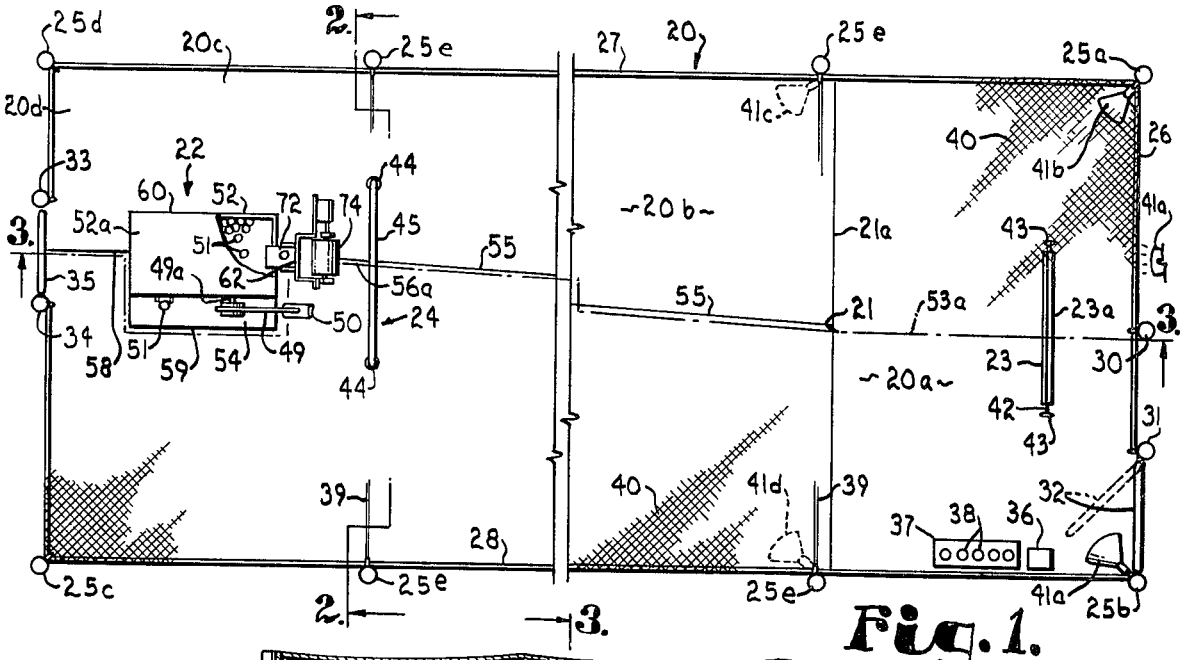
Fig. 1.
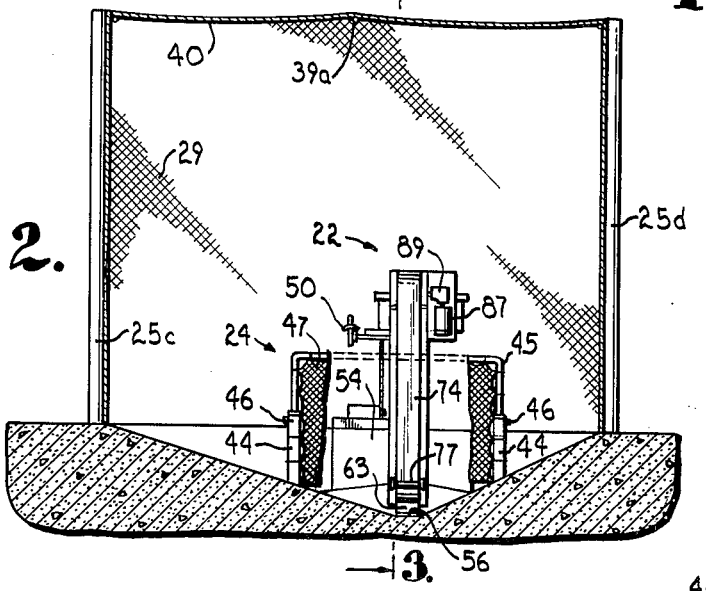
Fig. 2.
Fig. 3.
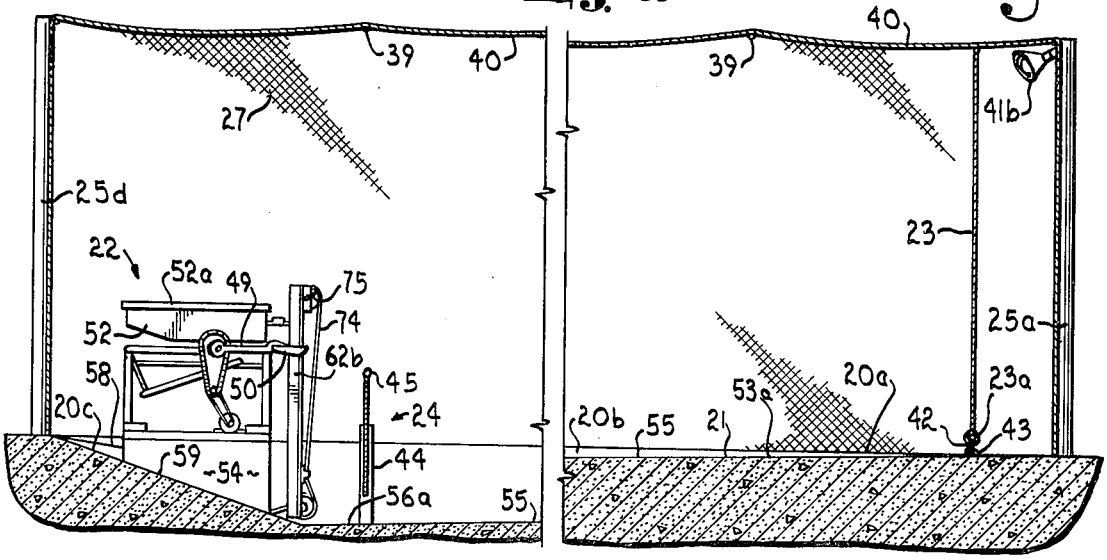

Fig. 4.
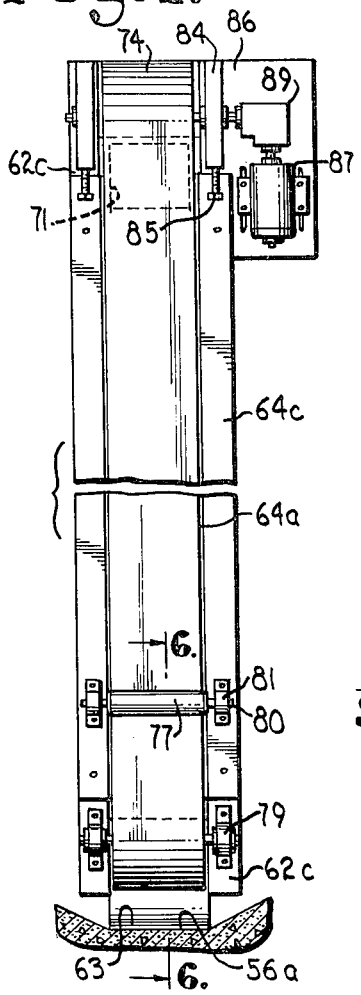
Fig. 6.
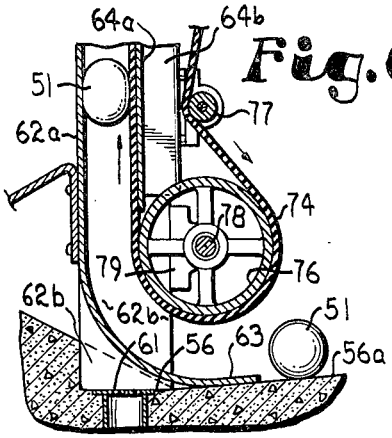
Fig. 7.
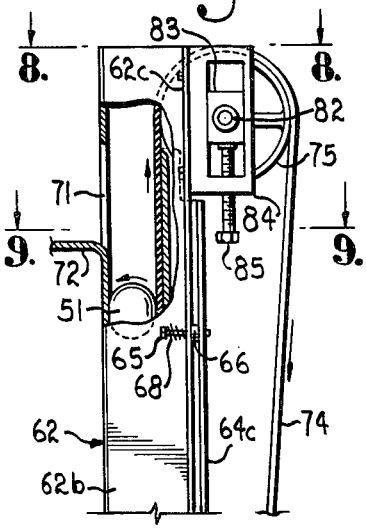
Fig. 5.
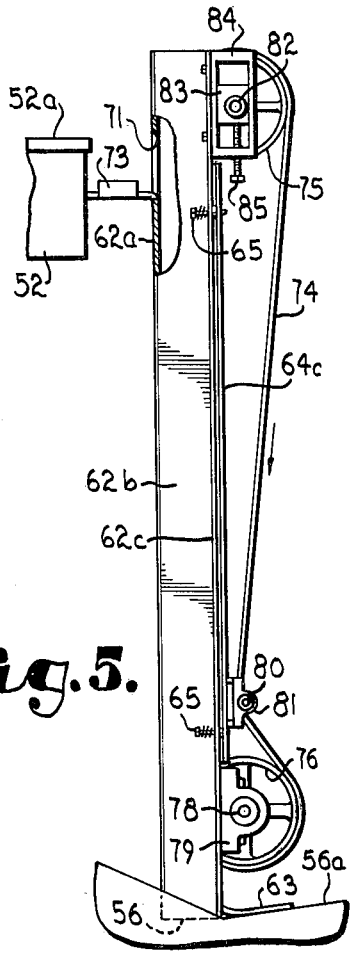
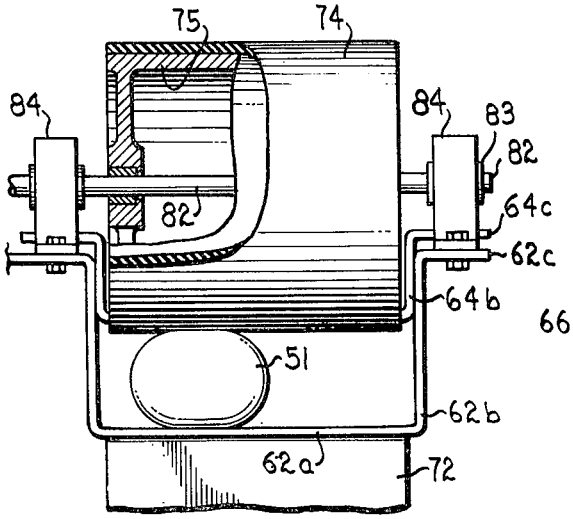
Fig. 8.
Fig. 9.
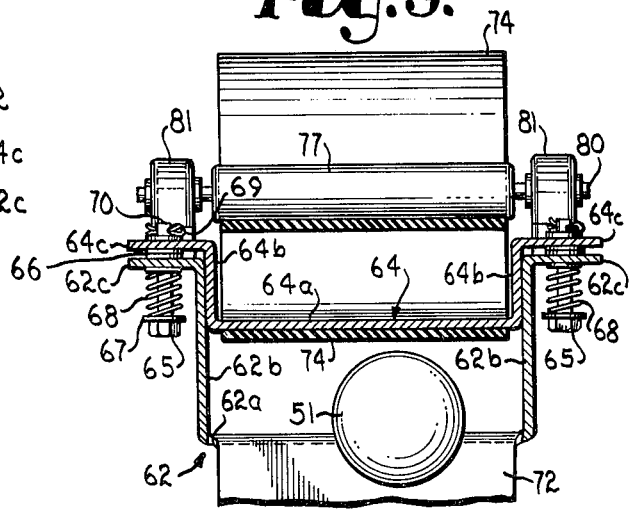

BASEBALL BATTING CAGES

OBJECTS OF THE INVENTION

An object of the invention is to provide a new, improved, limited area batting cage which will provide all of the advantages and operating characteristics of an unlimited area batting cage, yet confine the balls used in play within the said limited area.

Another object of the invention is provide such an improved limited area batting cage wherein the entire playing area is completely confined and screened within a limited zone yet there is no hinderance to the pitching and the hitting of the ball and, additionally, all of the balls either hit or missed (all of the balls hurled by the pitching machine) are automatically returned to a pickup zone adjacent the pitching machine.

Another object of the invention is to provide an improved floor configuration for a limited area batting cage and pitching machine mounting therein whereby all of the pitched balls in the batting cage, whether hit or missed, (or fouled) are immediately returned to the pitching machine for pickup by a automatic pickup and ball handling device.

Another object of the invention is to provide an improved ball pickup and return device which is simple in construction, dependable in operation, has a long life, does not jam and which continously and automatically returns balls fed to it into the storage hopper of a conventional ball pitching machine.

Yet another object of the invention is to provide such an improved ball pickup and return device which is adapted to be used in and make more operable a new and improved batting cage floor configuration which operates to return all pitched balls, whether hit, missed or fouled to the feed area of the said ball pickup and return machine.

Another object of the invention is to provide an integrated, improved, limited area batting cage device, construction and layout wherein all the elements of the system are readily available, most conveniently placed and usable in a minimum space to provide a complete batting cage operation without any reduction in the operability of the overall system or diminution in the batter's pleasure, despite the severely limited area of the cage.

Yet another object of the invention is to provide such a limited area batting cage construction, system and operation wherein the entire operation is automatic and self-sustaining without requirement of attention by the operator over a long period of time and without any requirement of reloading pitched balls into the pitching machine storage hopper at periodic intervals.

Yet another object of the invention is to provide such an improved batting cage construction, system and operation in a limited area wherein a plurality of the batting cage systems may be advantageously placed side by side, in an arcuate array with respect to a central operating hut or interspersed in the ways of a golf putting operation in such manner as to maximize the return to the operator of the batting cages while minimizing the attention required to oversee them and supervise them, while operating a maximum number of the systems and cages in a minimum space or area.

Other objects of the invention will appear in the course of the following description thereof.

In the drawings, which form a part of the instant specification and are to be read in conjunction therewith, embodiments of the invention are shown, as well as the operating parts thereof and, in the various views, like numerals are employed to indicate like parts.

FIG. 1 is a plan view of a batting cage and system constructed according to the instant improvement.

FIG. 2 is a vertical section taken along the line 2—2 of FIG. 1 in the direction of the arrows.

FIG. 3 is a vertical section taken along the line 3—3 of FIG. 2 in the direction of the arrows.

FIG. 4 is a front perspective view of the ball return and pick up machine shown in FIGS. 1–3, inclusive as positioned at the front of the pitching machine.

FIG. 5 is a side elevation of the device of FIG. 4 with portions cut away to better illustrate the structure of the device.

FIG. 6 is a view taken along the line 6—6 of FIG. 4 in the direction of the arrows, the view enlarged from the scale of FIG. 4.

FIG. 7 is an enlarged fragmentary view of the top portion of the device of FIGS. 4–6, inclusive, constituting the upper right hand portion of FIG. 5, the view enlarged and with parts cut away to better illustrate the construction.

FIG. 8 is a view taken along the line 8—8 of FIG. 7 in the direction of the arrows.

FIG. 9 is a view taken along the line 9—9 of FIG. 7 the direction of the arrows.

DESCRIPTION OF STRUCTURE AND FUNCTION

Figure 10:
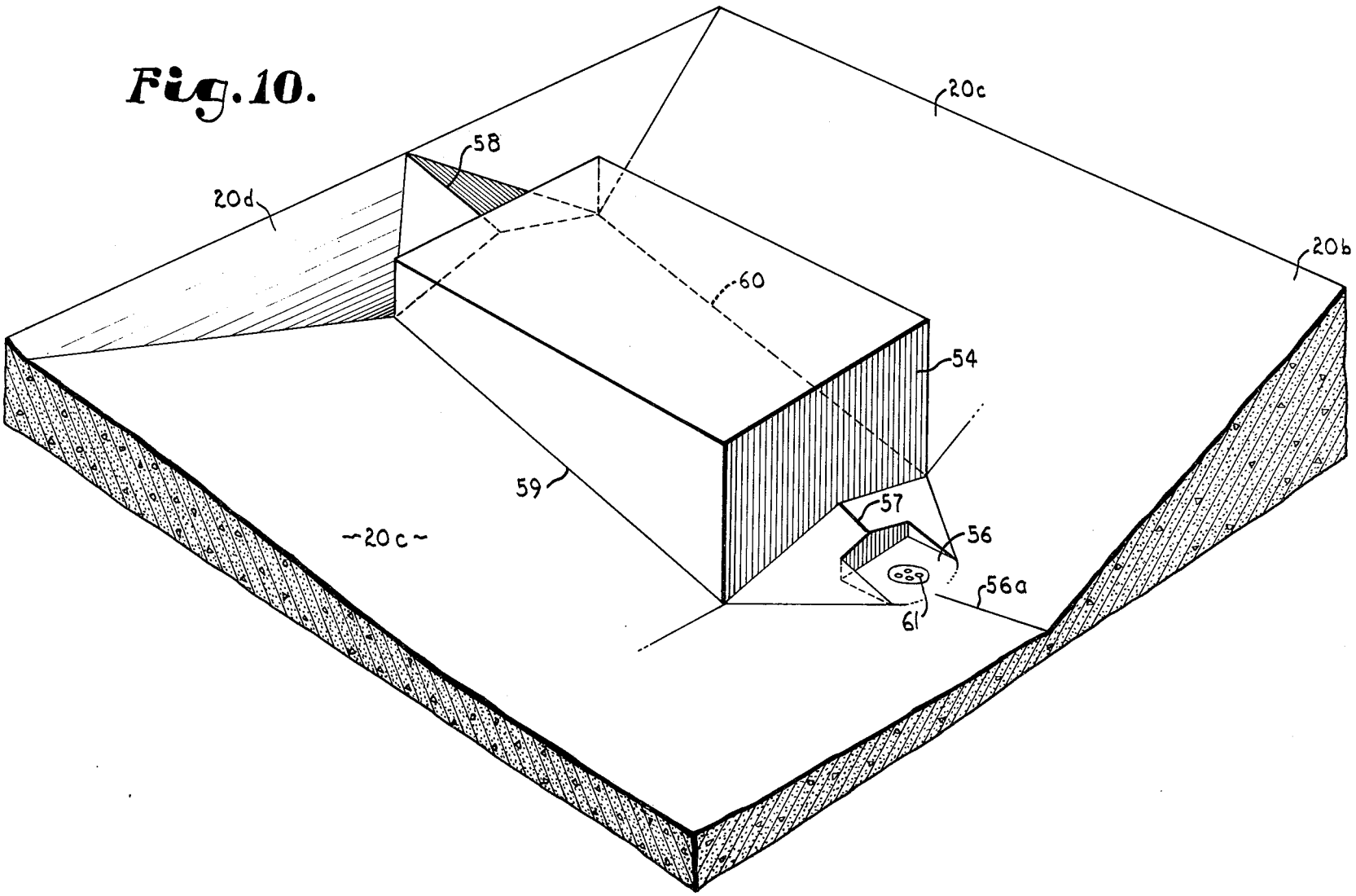
FIG. 10 is a fragmentary three quarter perspective view from above of the left hand end of the cage floor of the cage of FIGS. 1 and 2.

Referring first to FIGS. 1–3, inclusive, therein is shown, essentially schematically, the preferred layout of the parts of the reduced area batting cage system and array which is the subject of the instant invention.

The playing area is preferably substantially rectangular in plan view (FIG. 1) and is generally designated 20. A home plate zone (preferably not marked as an actual home plate for reasons to be described) is provided adjacent the spot designated 21. A conventional pitching machine of commercially available type, here generally designated 22, is provided closely adjacent or at the other end of the playing area, spaced away from the home plate zone 21 a distance approximating the Big League specified distance, as will be described. A vertically suspended, ball receiving screen (generally designated 23) is positioned behind the home plate area 21 a suitable distance to clear conventional batter swings from either side of the plate, as will be defined, screen 23 operative to receive pitched balls thrown by pitching machine 22 which are either missed by the batter or foul-tipped. A second screen generally designated 24, is provided and mounted in front of the pitching machine (to protect it from hit balls, over which the pitching machine hurls the pitched balls toward and to the home plate zone 21.

The home plate zone is preferably defined by a line 21*a* behind which the batter stands, rather than an actual plate indicated on the ground or floor of the cage. This line is also designated by the rules posted in the cage as a limiting line past which the batter is not permitted to move (toward the pitching machine), for safety purposes.

The four elements just recited (home plate zone 21, pitching machine 22, ball receiving screen 23 and protective screen 24, inclusive, and their specific spacing to be described) give the general layout of the playing area, together with the peripheral and overhead screening which will be described in the following, more specific description of the batting cage system, the parts thereof and apparatus employed.

A plurality of vertical posts 25*a–d,* inclusive, are provided at the four corners of the elongate, rectangular batting cage area with additional spaced, vertical poles 25*e* positioned along the side lines of the batting cage area. Vertical panels of screening, preferably of metal mesh fencing or the like, but alternatively of cord, cable or rope mesh, are provided between and supported by the said poles 25*a–e,* inclusive, thereby to provide a batter's end wall 26, two elongate, parallel side walls 27 and 28 and the opposite or pitching machine end wall 29, the latter preferably substantially parallel to the batter's end wall 26.

An additional, like, vertical post 30 is shown positioned centrally of the batter's end wall, whereby to provide additional support to the screening at that end. One or more like posts (not shown) may be provided at the opposite end 29 for screening support, if desired or necessary. The posts or poles 25*a–e* and 30 are preferably from 12 to 16 feet high. A door frame post 31 may be provided, as seen in the lower right hand corner of FIG. 1, next to, but spaced from corner post 25*b,* cooperating therewith at the batter's end of the playing area and mounting thereon a pivotable door 32 for access to and departure from the batter's end of the batting cage for a batter. Likewise, a door frame having vertical elements 33 and 34, one of which mounts a pivotable door 35 may preferably be installed in the pitching machine end wall 29 for access by the operator to the pitching machine for handy repairs, adjustment or the like. This may be a full height door (typically 7 feet) like door 32, but preferably is a lesser height door whereby entry of the operator into the area behind the pitching machine is preferably at least substantially screened by the pitching machine and the screen 24 in front thereof. This provides maximum safety should the operator decide to enter during use of the cage, for some reason.

At 36 is positioned the coin box for actuating the pitching machine, immediately inside door 32, while rack 38 is provided to hold bats of various sizes and weights.

A plurality of cables or wires 39 are provided extending between the upper ends of side posts 25*e,* whereby to uniformly support above the playing surface a substantially horizontal screen of rope, cord, cable or metal mesh 40. This ceiling screen is also connected at its side edges to the posts 25*e* (and preferably but optionally to the tops of the vertical panels 27 and 28) and further at its end edges to the posts 25*a–e,* inclusive and 30, as well as optionally but preferably to the top edges of the vertical end panels 26 and 29. With the pole or post height being 12 to 16 feet, the net or screen height at the ceiling will average typically 2 feet lower or 10 to 14 feet.

The reason for not marking a regulation size home plate at the point 21 is to minimize error on the part of the batter. In many wind conditions, particularly at right angles to the hurled ball path or even on a line with or against same, the ball hurled by the pitching machine may well considerably deviate from an actual called strike. The represented presence of a conventional home plate might well cause a batter to expect all balls to be thrown as strikes, which well might not be the case and thus increase hazard. Additionally, the lighter the ball thrown, the greater the variation in its trajectory, generally speaking. Yet further, the pitching machines commercially available may be adjusted for differing speeds which different speeds sometimes cause trajectory variation.

Turning to the overall dimensions of the batting cage layout seen in plan view in FIG. 1 a typical optimum set of length and width dimensions built around the basic elements previously described would be 14 feet wide and approximately 75 feet long. Certain minor variations maybe employed within these outer limits, but, certainly, a fully adequate batting cage system may be constructed within those dimensions given, a batting cage system having full play operability, full safety factors, full access from both ends for the batter and the operator, full space availibility for the bat rack and coin box, and plenty of free swing area for the batter from either side of the home plate area. These outer limits include the full regulation pitching distance of 60 feet 6 inches between the front end of the pitching machine (arm release point) and line 21*a.*

The optimal, preferred length and width measurements and measurements spacing the parts from on another will now be given with, further, the permissable variation also noted. Length measurements will be first given.

It should additionally be noted that the typical, conventional, commercially available pitching machine has a pitching arm which hurls the ball from one side or the other of the machine. Accordingly, it is desired to place the pitching arm of the machine on the center line of the batting cage area so that the pitched ball will be hurled axially and centrally of the batting cage area towards the centrally positioned (for equal access from both sides for left handed and right handed batters) home plate zone 21. Since the pitching arm of pitching machine 22 is on the center line and the body of the pitching machine laterally displaced with respect to the center longitudinal axis of the batting cage, this leads to certain required deviations (from symmetrical) in the floor configuration of the batting cage to be described.

Starting at the right hand side of FIG. 1, preferably there is provided approximately 2 feet between the end wall screen panel 26 and the ball receiving screen 23. With the positioning of batter access door 32 to one side of screen 23, this distance may be somewhat reduced, but preferably not much, in order that screen 23 may be extremely resilent, thus not to return (toward the batter) received, pitched balls from machine 22 too quickly. From screen 23 to the home plate zone 21 is preferably approximately 6 feet. This gives ample swing clearance of a batter on either side of the plate from screen 23. Thus, the home plate zone 21 itself may be defined as at least 6 feet forward of the center of the centrally positioned screen 23 or 8 feet forward of the center of screen panel 26, assuming a 2 foot clearance from the backside of screen 23.

As previously mentioned, the regulation distance from the back of the home plate zone 21 to the release point of the pitching machine arm is 60 feet 6 inches. With the pitching machine aligned with the pitching arm on the central axis of zone 20, there is then a straight line, axial distance of 60 feet 6 inches from the back of home plate zone 21 to the release point of the pitching machine arm. This release point corresponds essentially to the front wall of the pitching machine itself. For purpose of this description, taking into account the provision of one standard dimension, conventional, commercially available pitching machine, a flat, horizontal ground level mounting base 4 feet long and 32 inches wide is provided carrying the body of the pitching machine and providing a standing space laterally thereof (next to the pitching arm) for the operator to stand on when he is servicing the top of the machine. This gives an additional depth toward end wall panel 27 of 4 feet.

Finally, lengthwise, there is preferably 1½ to 2 feet provided between the backside of the pitching machine 22 and rear wall panel 27. If door 33 opens outwardly, the minimum such clearance (sufficient for a man to get into the cage) is required. If gate 35 is displaced laterally, out of the line of the pitching machine, the end wall 27 may be positioned essentially flush with the rear end (away from the batter) of the pitching machine. However, in such case, the access entrance is not protected, either by the pitching machine itself or the protective net 24.

Accordingly, the optimum total length of the batting cage from panel 26 to panel 29, assuming door 35 behind the pitching machine, is approximately 74 feet 6 inches. This preferred distance may be lessened about a foot by moving panel 26 that foot toward screen 23 and another 2 feet by laterally displacing door 35 and moving panel 29 up essentially to the rear of the pitching machine, if mimimum length is critical.

A minimum width for the batting area, which somewhat restricts full batting swings, would be 10 feet. A 12 foot width is quite serviceable with the batter's bat encountering one of the side panels only in the most unusual combination of stance and swing. Fourteen feet is the maximum width one would ever need.

The entire length of the batting cage floor from the center of panel 26 to the back of home plate zone 21, axially, and thereafter (deviating gradually from the true longitudinal axis) from the back of home plate zone 21 to, preferably, the front of the pitching machine (center thereof), is uniformly, downwardly sloped at the rate of ½ inch per foot. This means that there is a drop of 34¼ inches, in effect, from the center of the end wall panel 26 to the center of the front of the pitching machine. The purpose of this central, downward sloping of the floor of the batting cage is to insure the uniform return of balls hurled by the pitching machine to the front of the pitching machine and the ball pickup and return device to be described. Yet further, as will be described in detail, the floor of the cage immediately behind the pitching machine is recessed from center outwardly past the edges of the block or base supporting the machine past the sides thereof so that balls will not be captured in the zone immediately behind the pitching machine and its supporting base. The peripheral zone around the pitching machine and its supporting base is at ground level (where posts **25*d*, 33, 34 and 25*c* are positioned) with the floor of the batting cage, as it approaches the periphery of the base mounting the pitching machine recessed downwardly (FIGS. 2 and 3**) so ball return is fully effected around the entire periphery of the pitching machine and its support.

The entire periphery of the batting cage floor is at a horizontal plane level (see FIGS. 2 and 3) with the floor, as described, dropping away centrally, how much depending upon the longitudinal position in the cage, thus to provide a V-shaped trough running on a gentle incline from panel 26 to the front of the pitching machine at one end of the cage and more precipitate recesses running from panel 29 to the front of the pitching machine at the other end (left hand side of FIG. 3).

With this shaping, it may be seen that the entire batting area from panel 26 to home plate zone 21 is essentially flat with a maximum central drop from panel 26 to home plate zone 21 of only 4 inches. The whole purpose of this floor configuration, as well as the provision of the automatic pickup and return for the balls is to make the entire batting cage operation automatic requiring an absolute minimum of attention from the operator.

The configuration of the floor and the position of the various elements of the batting cage system must adapt to receiving and handling balls of all sorts, which essentially may be categorized as follows:

(1) Balls hurled by the pitching machine which are missed by the batter and strike screen 23;

(2) Balls foul-tipped or fouled by the batter which end up in screen 23 or strike the end panel 26 or door 32 or the right hand side (FIG. 1) of side panels 27 or 28;

(3) Well struck balls which typically hit the left hand ends of panels 27 or 28, end panel 29, screen 24 or the ceiling screen 40 (the latter may be true of some fouled balls, as well);

(4) It is possible for the ball, when fairly hit, to strike some exposed part of the machines, pitching machine or pickup and return device to be described, above the protective screen 24. Accordingly, these parts of the device should be strong or protected by suitable shielding.

The portion of the floor of the batting cage from screen 26 to line **21*a* is here designated 20*a* and the central axial portion thereof is numbered 53*a*, constituting a gradually deepening V-shaped trough running from a perfectly flat peripheral area at screen 26 centrally between the right hand ends of screens 27 and 28 to a depth (assuming zone 20*a* is 8 feet in length) of 4 inches at the center of line 21*a* which is the center of home plate zone 21. The portion of the floor from line 21*a* to the front of the pitching machine (and its supporting block 54) is designated 20*b* with, as previously described, the floor V-shaped in vertical transverse section with the lowest portion of the V being along the line 55 running to essentially the base of the block 54. Shortly in front of screen 24, the base of the V section is broadened and flattened as may be seen at 56*a* in FIG. 2** whereby the base of the ball pickup and return device (to be described) may be flat so the returned balls can roll up over the lip of the pickup portion of such device.

Thus, as the trough approaches the front of the pitching machine and the pickup and return device (to be described), the base of the V rounds out and becomes less sharp, whereby to phase into the flat zone 56 where the actual ball pickup is made. This broadening takes place under the screen 24 and approaching the base of the pickup machine as indicated at **56*a***.

Between the base of the pitching machine (front side) and the pickup and return device, the floor is arcuate (FIG. 10) with a high point at 57 so that no balls will lodge between the machine base block 54 and the backside of the pickup and return device. From the high point or high line 57, the floor tapers toward the flat zone 56 from the base 54 and to the sides so there is gravity feed back centrally to flat zone 56 at all points.

On the side of block 54 next screen 29 at the further end, there is also an arcuate tapering and fairing of the floor from screen 29 forwardly to the base of the block with a high zone at 58 falling away on each side thereof both laterally and toward block 54 from the rearmost portion of the cage. FIG. 10 illustrates all of the foregoing relationships in perspective so that it may be seen that there is no portion of the floor that does not gravity feed to the lowermost point 56. As may be seen in FIGS. 2, 3 and 10, the lateral floor lines 59 and 60 of the block 54 also feed downwardly toward the face of the block toward the batter with the floor zones at the sides of the block being designated 20*c* and between screen 29 and the rear of the support block 20*d*. The sides of the floor from line 21 to screen 29 would be symmetrical save for the asymmetrical positioning of the block 54 and pitching machine 22 in order to put the pitching arm on the center line.

The floor being configured to deliver balls always back to the zone 56 in front of the pickup and return machine, it is evident that this floor configuration will also deliver any water falling on the floor, such as rain, to the same point. Thus, there is provided a drain 61 centrally of the flat floor space 56.

Turning to the specific details of the installation, the lighting for evening and night use of the installation may be supplied by one or more lamps or lights 41*a–d*, inclusive. In all cases, the illumination should be away from the eyes of the batter (turned toward the pitching machine) and toward the pitching machine. The most important lamp is 41*a* directly behind the batter and directly shining down the path of the thrown ball. This provides the best possible illumination of the ball in its flight. The rest of the lamps are optional, depending on the total illumination of the scene, but the most important and serviceable of these lights or lamps would be 41*b* and its opposite equivalent 41*a* positioned on post 25*b* which both provide additional illumination behind the batter and on the ball in its flight toward the batter. Preferably, there are no lights past the posts essentially in line with the batting zone and home plate area.

Screen 23 is preferably at least 5 feet to 7 feet wide and is a continuous rope, cord or cable mesh extending downwardly from the ceiling mesh 40 and stopping somewhat short (not substantially more than ball diameter) of the floor. Preferably a bottom weight such as an elongate pipe 23*a* is carried or supported at the bottom of the screen 23 in order to give the screen inertia against the impact of a ball. Optionally, ties 42 may connect the outer ends of pipe 23*a* or the bottom of the screen 23 to cleats or stays 43 set into the concrete. The latter are particularly useful when the pitching machine is set at a higher speed and when heavier balls are employed, or both.

The screen 24 is preferably made up of two hollow cylindrical posts 44 into which the two downwardly extending legs of an inverted U-shaped frame 45 slidingly fit. Legs 45 are perforated in the lower portion of their length, at least, so that pins 46 may fix the height of frame 45 above the cylindrical numbers 44 to adjust the height of netting 47 as desired. The netting is secured to frame 45 and cylindrical members 44 by cables 48. The straight-across bottom edge 47*a* of net 47 permits the returned balls to roll under the netting to the ball pickup and return device (down the V section floor).

The pitching machine itself is of conventional type which will not be here described in detail save to point out that the pitching device has a suitable power source and springs driving pitching arm 49, which is pivotably mounted on driven shaft 49*a*. The arm 49 has a ball receiving (and hurling) sleeve or cup 50 at the end thereof which is operative, when the arm is positioned substantially 180° from the position seen in FIGS. 1 and 3, to receive balls 51 individually fed in controlled manner from the ball receiving and storing hopper 52 positioned on top of the pitching machine. This hopper has a removable cover on the top thereof 52*a*.

The pitching machine schematically illustrated in the Figures is manufactured by Commercial Mechanisms, Inc. of 7400 Birmingham Road, Kansas City, Missouri 64161, the specific model being W 600. This information is illustrative only and not limiting.

Turning to the device of FIGS. 4–9, inclusive, therein is shown the ball pickup and return device shown schematically in FIGS. 1–3, inclusive. In essence, this device comprises a vertical chute which communicates between the ground and the ball receiving hopper of the pitching machine. A conveyor belt continously moves along one side of the chute, as well as adjacent to the lower end feed opening of the chute to pick up the balls and move them vertically along the chute. The balls thrown by the pitching machine being somewhat resilent, and compressible, the walls of the chute are resilently moveable with respect to one another, under tension and adjustable with respect to the spacing therebetween. Means additionally are provided to drive the conveyor belt and adjust it for tightness.

Referring specifically to the drawings, an elongated U-section trough member generally designated 62 has a base wall member 62*a* to which are connected, at right angles, two elongate side wall members 62*b*, said side wall members having at the ends thereof elongate flanges 62*c* extending at right angles thereto. The lower end of base wall member 62*a* is arcuately formed (FIG. 6) as at 63. Positioned partially within and aigned with trough member 62 is a like, but shallower, trough member generally designated 64 having base wall member 64*a*, side members 64*b* extending at right angles thereto and flanges 64*c* extending at right angles to wall members 64*b*. A plurality of non-threaded bolt members 65 connect the flanges 62*c* and 64*c* at a plurality of points along the length thereof with the said flanges spaced apart by washers 66 therebetween. Additional washers 67 are provided on the bolts adjacent the enlarged heads and next flanges 62*c* carrying springs 68. Wire retainers 69 removably fit in holes 70 in the opposite ends of the bolts to complete the resilent mounting of the two trough members 62 and 64 with respect to one another, the spacing variable therebetween by addition or removal of washers 66.

At the top end of base wall member 62*a* of trough member 62, there is provided an opening 71 for egress of balls from the top of the chute for passage into the ball storage hopper 52 through an opening in the side thereof next to the batter over a platform 72. Platform 72 may be formed from the base wall 62*a* (as seen in FIGS. 5 and 7) and guide flanges 73, to keep the balls from falling off platform 72, may be provided of any desired size thereon.

It may be noted that the trough member 64 is shorter at both its lower and upper ends than the trough member 62 and is configured at its respective ends as seen in FIGS. 6 and 7.

An endless conveyor belt 74 is rotatably mounted over two cylindrical wheels 75 (upper) and 76 (lower). An additional tightener roller 77 also engages belt 74, preferably positioned closely adjacent the non-driven pulley 76. Cylindrical pulley or wheel 76 is mounted on shaft 78, rotatably received in bearing blocks 79 which are fixed to the flanges 62*c* of trough member 62 below the lowermost extremity of trough member 64. Tightening roller or pulley 77 is mounted on shaft 80, rotatably received in bearing blocks 81 which are fixed to the outboard surface of flanges 64*c* adjacent their lower extremity. Cylindrical pulley or roller 75 is mounted on shaft 82 which is rotatably received in bearing blocks 83. The latter are longitudinally adjustably mounted in frames 84 which are fixed to the outer faces of flanges 62*c* above the uppermost extremity of flanges 64*c*. Screw members 85 operate to longitudinally adjust bearing blocks 83 with respect to frames 84.

Fixed to trough number 62 at the upper end thereof (or comprising an extension of one flange 62*c*) is a mounting plate 86 which extends parallel to or as an extension of one of said flanges 62*c*. Mounted on plate 86 is a conventional power source 87, such as an electrical motor, driving shaft 88 which connects into right angle gear box 89, the other side of which receives shaft 83. Thus, motor 87 drives shaft 88 and, through the gearing in box 89, shaft 82. This rotates pulley 75, driving conveyor belt 74.

If it is desired to mount the motor 87 on the frame of the pitching machine such may be done. Alternatively the ball pickup and return device may be coupled to and driven by the motor which operates the pitching machine. In this way ball pickup is coordinated with actual use of the machine.

With the pulleys 75 and 76 being driven in a clockwise direction in the views of FIGS. 5–7, it will be seen that conveyor belt 74 moves downwardly outside of the chute and upwardly inside thereof. Balls 51 are seen in various positions under compression in the chute in FIGS. 6–8, inclusive with a ball about to enter the chute in the lower right hand portion of FIGS. 6 and exiting out opening 71 in FIG. 9. In the event the belt needs tightening, over long use, rotating screw members 85 to move bearing blocks 83 upwardly in the views of FIGS. 5 and 7 will tighten the belt. The presence of a plurality of "used" balls in the trough leading to the pickup zone 56 tend to force the balls closest thereto into the chute to be picked up by the conveyor belt rotating around roller or pulley 75. In the event that springs 68 weaken or different size or resilience balls are used, washers may be added or removed at 66, as required, to space the walls 64*a* and 62*a* from one another the correct distance.

Thus it may be seen that, once the batter enters the door 32, picks a bat and puts a coin into coin box 36, the entire operation of the batting cage is automatic. The batter steps up to the home plate zone, clearly indicated by the juncture of the shallow trough 53 and line 21. The pitching machine, with the customary several second delay from insert of the coin, switches on its warning light (typically red) facing the batter on the front of the machine and then begins delivering the balls, pitched, to the batter. The batter either strikes the balls or misses them. Missed, fouled, foul-tipped and fair hit balls all end up, due to the configuration of the floor, at the feed zone in front of the ball pickup and return device, which operates continuously (or intermittently if coupled to the pitching machine power source).

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contempleted by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A limited area batting cage comprising, in combination, a substantially rectangular playing area and surface having a length substantially greater than 61 feet and a width substantially greater than 10 feet, a home plate zone positioned adjacent one end of the area and also substantially centrally thereof, a ball pitching machine having an elevated ball storage hopper and a ball throwing arm associated therewith adjacent the other end of the area, said pitching machine positioned with its throwing arm aligned substantially along the central, longitudinal axis of said rectangular playing area, whereby a ball thrown by the machine moves substantially longitudinally axially of the area and to the center of the home plate zone, at least the periphery of the said playing area, in its entirety, horizontal and level, the said rectangular playing area and surface framed by vertical screening at the periphery thereof on all four sides, the rectangular playing area thus having two end wall and two side wall screens, a ceiling screen roofing the entire enclosed area and surface, a pitched ball-receiving screen positioned behind home plate, the playing area and surface being downwardly sloped from the longitudinal sides toward said central longitudinal axis and sloped substantially uniformly from a point well back of the center of the home plate zone to closely adjacent the front of the pitching machine in such manner that a transverse vertical section through the playing area and surface between the home plate zone and pitching machine will give a substantial V-shaped cross-sectional profile with the depth and slope of the V increasing going toward the pitching machine from the home plate zone, the pitching machine elevated on a pedestal block which is level with the horizontal periphery of the playing area, the playing area to the sides of the pitching machine and any of said playing area existing to the rear of the pitching machine and the block mounting same being recessed, sloped and configured so that all balls reaching the playing area zone past the front of the pitching machine and block supporting same will be gravity returned to the front of the block and pitching machine, and an automatic ball pickup and return device positioned in front of the pitching machine for picking up played balls and returning them to the pitching machine ball storage hopper.

2. A batting construction as in claim 1 wherein the width of the playing area in the vicinity of the home plate zone is substantially 4 feet wide and the distance from the back of the home plate zone to the front of the pitching machine supporting block is 60 feet 6 inches, with the distance from the back of the home plate zone to the ball-receiving screen approximately 6 feet.

3. A batting cage construction as in claim 1 wherein the ball pickup and return device comprises, in combination:

an elongate, vertical chute which is rectangular in horzontal transverse section, said chute having substantially vertical forward and rearward walls positioned with respect to the home plate zone, respectively, and substantially vertical side walls, said chute positioned in front of the pitching machine, with its lower end at the lowest point of the playing area.

said chute extending from ground level at its lower end to adjacent the top of the elevated ball storage hopper at its upper end, a ball-receiving inlet at the lower end of said chute facing the home plate zone, a ball dispensing outlet at the upper end of said chute facing the ball-receiving hopper, a endless conveyor belt associated with said chute, said conveyor belt mounted on and carried by pulleys positioned at the upper and lower ends of the chute and running on one side thereof in the chute from the lower end to the upper end thereof, the pulley and belt at the lower end forming a portion of the ball-receiving inlet, the pulley at the upper end positioned at least as high as the ball dispensing outlet, and means driving one of said pulleys and said belts.

4. A limited area batting cage comprising in combination, a substantially rectangular playing area and surface having a length greater than 61 feet and a width greater than 10 feet, a home plate zone positioned adjacent one end of the said area and also substantially centrally thereof, a ball pitching machine having an elevated ball storage hopper and ball throwing arm associated therewith adjacent the other end of the area, said pitching machine positioned with its throwing arm aligned substantially along the central longitudinal axis of the rectangular playing area, whereby a ball thrown by the machine moves substantially longitudinally axially of the area in moving to the center of the home plate zone, the said rectangular playing area and surface framed by vertical screening on all four sides thereof, a ceiling screen roofing the entire enclosed area and surface, a vertically adjustable screen positioned transverse said playing surface and in front of the pitching machine over which the pitching arm hurls the balls to the plate, a pitched ball receiving screen behind some plate, the playing area and surface being downwardly sloped from the longitudinal sides towards said central longitudinal axis and sloped from back of the center of the home plate zone to adjacent the front of the pitching machine in such manner that a transverse vertical section through the playing area and surface will give a substantial V-shaped cross-sectional profile with the depth and slope of the V increasing going toward the pitching machine from home plate, and an automatic ball pickup and return device positioned in front of the pitching machine for picking up played balls and returning them to the pitching machine ball storage hopper, the automatic ball pickup and return device comprising, in combination:

an elongate, vertical chute which is rectangular in horizontal transverse section, said chute having substantially vertical forward and rearward walls positioned with respect to the home plate zone, respectively, and substantially vertical side walls, said chute positioned in front of the pitching machine, with its lower end at the lowest point of the playing area, said chute extending from ground level at its lower end to adjacent the top of the elevated ball storage hopper at its upper end, a ball-receiving inlet at the lower end of said chute facing the home plate zone, a ball dispensing outlet at the upper end of said chute facing the ball-receiving hopper, an endless conveyor belt associated with said chute, said conveyor belt mounted on and carried by pulleys positioned at the upper and lower ends of chute and running on one side thereof in the chute from the lower to the upper end thereof, the pulley and belt at the lower end forming a portion of the ball-receiving inlet, the pulley at the upper end positioned at least as high as the ball dispensing outlet, means driving one of said pulleys and said belts, and the front and rear walls of the chute being resiliently mounted with respect to one another.

5. A limited area batting cage comprising, in combination, a substantially rectangular playing area and surface having a length greater than 61 feet and a width greater than 10 feet, a home plate zone positioned adjacent one end of the said area and also substantially centrally thereof, a ball pitching machine having a elevated ball storage hopper and ball throwing arm associated therewith adjacent the other end of the area, said pitching machine positioned with its throwing arm aligned substantially along the central longitudinal axis of the rectangular playing area, whereby a ball thrown by the machine moves substantially longitudinally axially of the area in moving to the center of the home plate zone, the said rectangular playing area and surface framed by vertical screening on all four sides thereof, a ceiling screen roofing the entire enclosed area and surface, a vertically adjustable screen positioned in front of the pitching machine over which the pitching arm hurls the balls to the plate, a pitched ball receiving screen behind home plate, the substantial center portion of the playing area and surface being downwardly sloped from the longitudinal sides towards said central longitudinal axis and sloped from back of the center of the home plate zone to adjacent the front of the pitching machine in such manner that a transverse vertical section through the playing area and surface will give a substantial V-shaped cross-sectional profile with the depth and slope of the V increasing going toward the pitching machine from home plate, and an automatic ball pickup and return device positioned in front of the pitching machine for picking up played balls and returning them to the pitching machine ball storage hopper, the automatic ball pickup and return device comprising, in combination:

an elongate, vertical chute which is rectangular in horizontal transverse section, said chute having substantially vertical forward and rearward walls positioned with respect to the home plate zone, respectively, and substantially vertical side walls, said chute positioned in front of the pitching machine, with its lower end at the lowest point of the playing, said chute extending from ground level at its lower end to adjacent the top of the elevated ball storage hopper at its upper end, a ball-receiving inlet at the lower end of said chute facing the ball-receiving hopper, an endless conveyor belt associated with said chute, said conveyor belt mounted on and carried by pulleys positioned at the upper and lower ends of chute and running on one side thereof in the chute from the lower to the upper end thereof, the pulley and belt at the lower end forming a portion of the ball-receiving inlet, the pulley at the upper end positioned at least as high as the ball dispensing outlet, and means driving one of said pulleys and said belts, said chute made up of two elongate trough members which are hat-shaped in horizontal transverse section, one of said members of lesser depth than the other partially received within the greater depth member.

* * * * *